US005119847A

United States Patent [19]

Powell et al.

[11] Patent Number: 5,119,847

[45] Date of Patent: Jun. 9, 1992

[54] APPARATUS AND METHOD FOR AXIALLY TWISTING HAIR

[75] Inventors: Terri Powell, Smyrna; Karl Kunisch, Fayetteville, both of Ga.

[73] Assignee: Quartern Group, Fayetteville, Ga.

[21] Appl. No.: 579,376

[22] Filed: Sep. 10, 1990

[51] Int. Cl.[5] ..... A45D 2/12

[52] U.S. Cl. ..... 132/226; 132/210; 132/238

[58] Field of Search ..... 132/223, 224, 226, 238, 132/271, 263, 265, 266, 210, 237

[56] References Cited

U.S. PATENT DOCUMENTS

| | | | |
|---|---|---|---|
| 1,360,861 | 11/1920 | Alberghini | 132/226 |
| 1,463,028 | 7/1923 | Agostini | 132/238 |
| 1,463,085 | 7/1923 | Hungerbühler et al. | 132/226 |
| 1,825,540 | 9/1931 | Pausser | 132/223 |
| 2,524,058 | 10/1950 | Kamara | 132/238 |
| 2,575,184 | 11/1951 | Moses et al. | 132/263 |
| 2,586,103 | 2/1952 | Smith | 132/238 |
| 2,619,094 | 11/1952 | Ralston | 132/238 |
| 4,166,472 | 9/1979 | Battaglia | 132/229 |

FOREIGN PATENT DOCUMENTS 1017008 11/1952 France .

OTHER PUBLICATIONS

Article from *St. Louis Post-Dispatch*, Feb. 4, 1990, entitled "A New Twist On Hair".

*Primary Examiner*—Cary E. O'Connor
*Assistant Examiner*—Michael Lynch
*Attorney, Agent, or Firm*—Jones, Askew & Lunsford

[57] ABSTRACT

A probe for twisting hair axially is disclosed comprising a pair of fingers biased together by an elasticized band seated within an annular grove around the exterior of the probe. A slot is defined between the fingers for receiving and holding a group of hair to be twisted. Also disclosed is an apparatus for twisting hair comprising a probe as described above and an electrically driven spindle for rotating the probe. The probe is aligned longitudinally with a group of hair held in the slot between the fingers on the probe. The probe is rotated to twist the hair axially and thereby form loops and folds of the rope-like axially twisted hair. The hair is removed from the probe and pinned.

15 Claims, 2 Drawing Sheets

APPARATUS AND METHOD FOR AXIALLY TWISTING HAIR

TECHNICAL FIELD

The present invention relates to a method and apparatus for styling hair, and more particularly relates to a method and apparatus for axially twisting hair for forming looping and folding groups of hair.

BACKGROUND OF THE INVENTION

Hairstyling is a popular and extensively practiced art. In styling hair, it is well known to curl or twist hair. Curled hair is concentrically wound. Twisted hair is axially twisted. Hairstylists wind or twist hair to form curls, waves, and ropes of long hair. Such ropes may be loose or folded into large loops.

One hair styling technique which has recently gained popularity involves forming a number of looping and folded groups of hair on an individual's head. The stylist selects a group of hair and axially twists the hair from the end. A stylist practicing this techique uses both hands. The stylist holds the selected group of hair in one hand and twists the group axially by rotating the wrist. The stylist then grasps the group of hair with the other hand and releases the first hand. Holding the hair with the second hand prevents un-twisting. The stylist then rotates the second hand to twist the hair axially again or alternatively, the first hand re-grasps the end of the group and rotates to twist the hair axially. The grasp, twist, re-grasp and release is repeat several times, depending on a number of factors, including the length of the hair, the tightness to which the hair is twisted, and the desired size of the hair loops. The length of the group of hair becomes shorter in response to the axial twisting, and the stylist allows the hair to fold and loop while the axial twisting continues. When the group of hair loops against the head, the end of the hair is pinned, and the process started again with another group of hair. Such twisting is very time consuming, and an average styling may take about three hours to complete. The quality of the styled hair is also highly dependent upon the stylist's skill.

A variety of devices exist to curl hair, the simplest being hair curlers which are cylinders having prongs extending outwardly therefrom. However, hair has heretofore been twisted axially by hand. Currently, hair is axially twisted by manually twisting the hair against itself or against a rolled piece of paper, as discussed above.

Many devices are known in the prior art for concentrically curling hair; however, it is believed that none of these devices are suitable for axially twisting hair. One example is shown in U.S. Pat. No. 2,586,103 issued to Smith. The '103 patent describes an electrically operated hair curler used to roll or curl hair concentrically. This device has several disadvantages which do not make it practical for axially twisting hair. For example, the tapered shape of the spindle 21 does not apply pressure evenly along the longitudinal axis of the spindle. An uneven longitudinal pressure causes the strands of hair to become entangled and hard to manipulate. In addition, the open design of the slot on the spindle does not restrict the hair from falling out of the spindle when trying to axially twist hair along the longitudinal axis of the hair.

Another example of a hair curler found in the prior art is shown in U.S. Pat. No. 4,166,472 which issued to Battaglia. The '472 patent describes a curler haivng a circle of prongs 41 which extend as cantilevers from a base. These prongs, likewise, are not effective in retaining hair when trying to longitudinally twist the group of hair. The prongs function to retain the group of hair reliably only when the prongs are positioned substantially perpendicular to the hair. Such a device curls hair concentrically.

U.S. Pat. No. 2,524,058 issued to Kamara describes a conventional "alligator clip" type hair curler for forming concentric curls. An electric motor winds the hair into curls rather than forming curls by manual winding of the hair by the stylist. When used to concentrically curl hair, the concentric wraps of hair would be expected to apply relatively uniform pressure on hair within the clip. However, when axial twisting hair, hair is not concentrically wrapped around the clip and is therefore not available to apply pressure.

Therefore, the various efforts found in the prior art are directed to curlers suitable for forming concentric curls of hair. There remains a need in the art for a device to allow expeditious axial twisting of hair, for a device which is capable of providing more uniform pressure to prevent tangling of hair while styling, for a device which is capable of retaining hair placed substantially parallel in the device, and a device for creating hair styles which are not highly dependent upon the stylist's skill in twisting groups of hair.

SUMMARY OF THE PRESENT INVENTION

The present invention advances the art by providing a probe which readily receives and securely holds hair and which distributes pressure along the length of the hair, thus allowing even axial twisting of the hair. in addition, the present invention provides an apparatus which greatly reduces the skill and the time required to twist hair axially during styling.

Generally described, the present invention provides a probe for receiving hair to be twisted axially. The probe comprises a pair of fingers biased together, the fingers being positioned to have facing and non-facing surfaces, the facing surfaces defining a slot for receiving and holding a group of hair to be twisted; and means for yieldably biasing the fingers towards one another, said means being positioned intermediate the ends of said fingers such that said hair is maintained in said slot by said means for yieldably biasing such that said hair may be evenly twisted about its longitudinal axis.

The preferred embodiment provides an apparatus for twisting hair comprising a probe, which includes a pair of fingers biased together and positioned to have facing and non-facing surfaces defining a slot for receiving and holding a group of the hair to be twisted; an annular groove around the probe defined on the non-facing surfaces; and means for yieldably biasing the fingers towards one another seated within the annular groove. An electrically driven spindle is detachably connected to the probe for rotation of the probe.

The present invention also provides a method styling hair on an individual's head into loops and folds of twisted hair, comprising: placing and end of a group of hair in a slot defined by facing surfaces of a probe having a pair of fingers biased together; aligning the probe with the longitudinal axis of the hair extending from said head; rotating the probe to twist the hair axially to form loops and folds of twisted hair; removing the hair from the probe; and securing the end of the hair to prevent the hair from untwisting.

Thus, it is an object of the present invention to provide a mehod and apparatus for axially twisting hair.

It is a further object of the present invention to provide a probe for axially twisting hair for hair styling.

It is a further object of the present invention to provide an apparatus which reduces the skill and time required to axially twist hair for hair styling.

It is a still further object of the present invention to provide a probe for curling or twisting hair which distributes relatively uniform pressure on the group of hair to be twisted axially to allow for even twisting without entangling the hair while providing sufficient pressure on the hair to retain it within the probe for axial twisting.

Other objects, features, and advantages of the present invention will become apparent upon reading the following detailed description of preferred embodiments of the invention, when taken in conjuntion with the accompanying drawings and the appended claims.

DETAILED DESCRIPTION OF THE DRAWINGS

Figure 1:
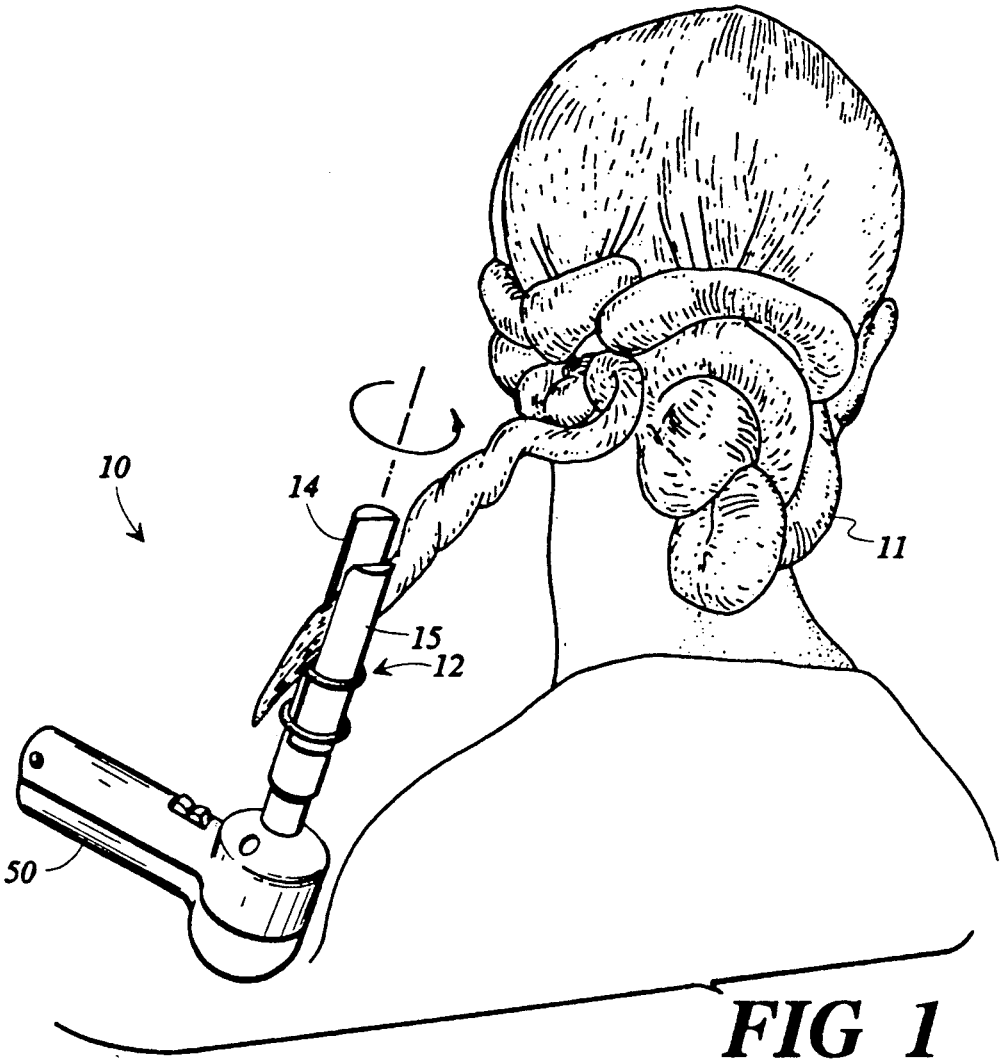
FIG. 1 is a pictorial view of a preferred embodiment of a hair styling apparatus according to the invention for axially twisting hair into loops and folds for a hairstyle.

Referring to the drawings, in which like numerals refer to like parts throughout the serveral views, FIG. 1 shows a hair twisting device 10 embodying the present invention being used to axially twist hair for styling into loops 11. The device 10 includes a probe 12 and an electrically powered drive unit 50.

Figure 2:
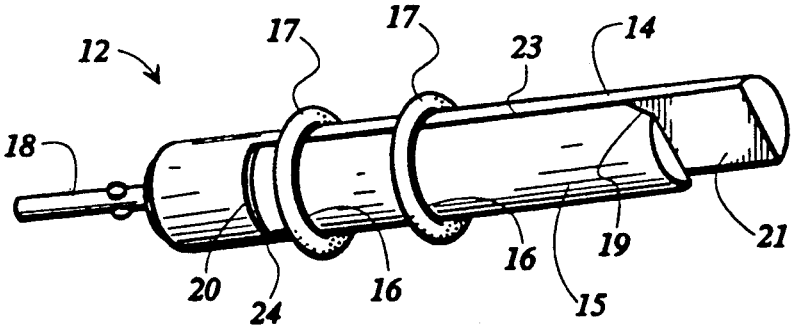
FIG. 2 is a pictorial view of a preferred embodiment of a probe for axially twisting hair according to the invention.
Figure 3:
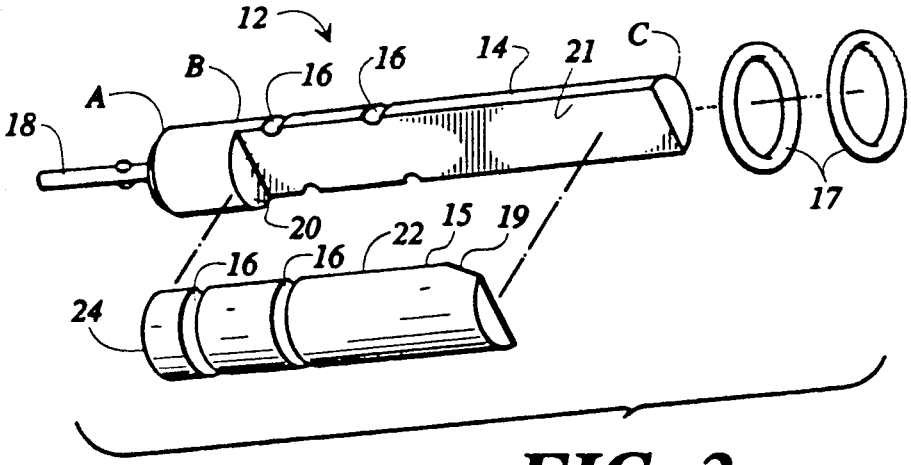
FIG. 3 is an exploded view of the preferred embodiment of the probe shown in FIG. 2.

Referring to FIG. 2, the probe 12 includes a first finger 14, a second finger 15, a pair of annular groves 16 defined on the outer surface of the fingers 14 and 15 (as best seen in FIG. 3), a pair of elasticized bands 17, and a drive shaft 18. With reference to FIG. 3, the first finger 14 is preferably of a cylindrical shape between points A and B, and is preferably of semi-cylindrical shape between points B and C. This provides a shoulder 20 against which the second finger 15 is abuttingly positioned. The shoulder 20 prevents the second finger from sliding towards the drive shaft 18. The second finger 15 is preferably shorter than the first finger and is of semi-cylindrical shape, except for a sloped end section 19. However, it will be understood that the fingers can be the same length, as shown in the alternate embodiment of FIG. 5, discussed below.

It may be further understood that the fingers may if desired be connected at the shoulder 20 by a hinge or other attachment means.

An important feature of the invention is applying a relatively uniform pressure on the group of hair to be twisted axially to allow for even twisting without entangling the hair while providing sufficient pressure on the hair to retain it within the probe for axial twisting. In contrast, to concentrically curl hair using conventional devices such as an alligator clip device, only minimal pressure is needed to retain the hair within the clip. This pressure is typically supplied by a spring located at one end. Once curling is initiated, the pressure supplied by the overlying curls retains the hair within the clip. The pressure supplied by the clip contributes only to initially retain the hair within the clip.

When axially twisting hair, hair is not uniformly wound around a device such that the hair is able to provide pressure to maintain the end of the hair within the twisting device. Thus, sufficient retaining pressure must be supplied independently and continuously. Also, applying a relatively uniform pressure helps to prevent tangling of the hair. In the present invention, the bands 17 urge the fingers 14 and 15 together to retain the hair. Also, because of their location intermediate the ends of the fingers 14 and 15, the bands provide sufficient, uniform pressure to retain the hair in a manner which allows for even untangled twists of hair.

The semi-cylindrical fingers 14 and 15 each define flat facing surfaces 21 and 22, respectively. Flat surfaces are provided to ensure a uniform surface for holding hair. In the preferred embodiment, the surfaces are about one inch wide. However, it will be understood that any shape or surface which effectively retains the hair may be used. The fingers 14 and 15 are preferably plastic or nylon, and the shaft 18 is perferably nylon or metal. Light, strong components are preferred to provide durability and to reduce fatigue to the stylist. The drive shaft 18 is attached directed to the first finger 14, preferably by either inserting the shaft 18 within a bore within the first finger or by co-extruding the shaft with the first finger.

To assemble the probe 12, the surface 21 of the second finger 15 is placed against or in very close proximity to the surface 22 of the first finger 14. The fingers 14 and 15 are aligned such that the probe is generally cylindrical in shape along its length. This provides for cylindrical twists. However, other shapes could be provided by varying the external shape and dimensions of the probe. The fingers 14 and 15 are held in an abutting relationship by sliding the bands 17, preferably being rubber O-rings, around the circumference of the probe such that one band 17 is seated in each of the grooves 16. When the probe 12 is assembled, the abutting surfaces 21 and 22 form an expandable receiving slot 23 for receiving and holding the hair to be twisted. The sloped section 19 provides a guiding surface which facilitates insertion of the hair within the slot 23. The end section 24 is positioned abutting the shoulder 20 to prevent the second finger 15 from sliding towards the drive shaft 18, thus providing a sturdier assembly. The bands 17 maintain a substantially even distribution of pressure along the surfaces 21 and 22 such that hair inserted within the slot 23 is retained solely by the pressure supplied by the bands and independent of the orientation of the probe to the hair shaft. This feature facilitates the twisting of hair into uniform twists by providing a probe which reliably grips hair placed between the fingers even though the probe may be longitudinally aligned with the hair such that concentric winds of hair around the probe are not present.

The assembled probe may then be used by the stylist to twist hair axially. In use, the stylist grasps a group of hair to be axially twisted into loops and curls. Generally the group has a diameter of about one inch, although the diameter may be larger or smaller depending on the desired style or design effect to be achieved. The stylist may selectively apply a styling gel to the hair to assist the styling. The stylist pinches together the ends of the hair in the group and then the stylist places the end section of the group of hair into the probe. This is done by placing hair on the sloped section 19 and slidably inserting the hair into the slot 23. The stylist aligns the probe 19 logitudinally with the group of hair extended radially from the head and then axially rotates the hair. Rotation may be accomplished by either holding the shaft 18 in a stylist's hand and manually rotating the shaft 19, or preferably by inserting the shaft 19 into the electrically powered drive unit 50, for powered rotation.

During power rotation, the powered drive unit 50 acts to slowly twist the group of hair held by the probe. The twisting action pulls the probe and the power unit toward the head and the twisted hair loops and folds into a knot. Twisting is stopped when the knot is appropriately tight for the particular style. The stylist then slips the end of the twisted hair from the probe and pins or otherwise secures the end to prevent the twisted hair from untwisting. This process may be repeated until the hair for the style is twisted and secured into the desired style.

Figure 5:
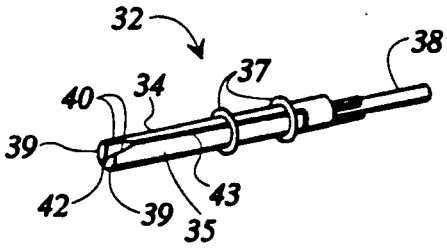
FIG. 5 is a pictorial view of an alternate embodiment of a probe for use with the hair styling apparatus shown in FIG. 1.

FIG. 5 shows an alternate embodiment of a probe 32 according to the present invention. The probe 32 includes a first finger 34, a second finger 35, a pair of annular grooves 36, a pair of elasticized bands 37, and a drive shaft 38. In this embodiment, the fingers 34 and 35 are configured such that when assembled, the probe is generally cylindrical in shape, with the exposed ends 39 of the fingers being substantially even. A notch 42 is defined by the boundaries of surfaces 40 provided on each of the fingers 34 and 35 and surfaces 40 are formed by sloping a corresponding corner section of each finger outwardly and into the plane of each finger. The notch 42 is useful in guiding hair into slot 43 formed by placing fingers 34 and 35 together. The probe 32 is constructed and assembled in the same manner as probe 12, with bands 37 being seated within grooves 36. Operation of the probe 32 is likewise similar to that of probe 12, with hair being received and held by slot 43, and the twisting of the hair being accomplished by axial rotation of the drive shaft 38.

Figure 4:
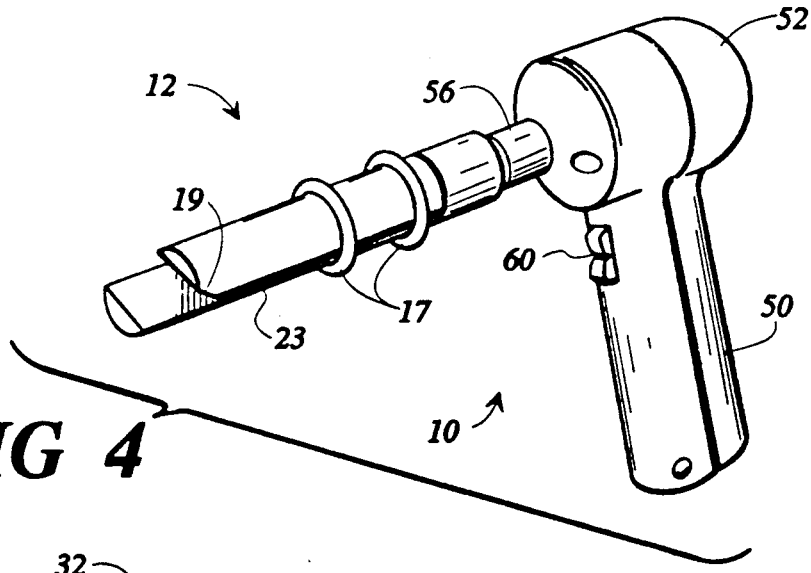
FIG. 4 is a perspective view of the preferred embodiment of the hair styling apparatus shown in FIG. 1.

Referring to FIG. 4, the drive unit 50 includes a housing 52, an electric motor within the housing, a chuck 56 for functionally engaging the drive shafts 18 and 38, and an on-off switch 60. The drive unit 50 is preferably of conventional construction, examples of which are used to power egg-beaters, drills and other rotary devices and can be operated with batteries or power cord, such batteries preferably being rechargeable batteries. The drive unit also preferably utilizes a slip mechanism or clutch to prevent hair from being overtightened. One example of such a device is described in U.S. Pat. No. 2,586,103, which is incorporated herein by reference.

It will be seen that while the probes 18 and 38 are designed primarily for axially twisting hair, it will be understood that the probes may also be used to concentrically curl hair. It will also be understood that the probes may be heated prior to use with an external heat source. One example of such a device is described in U.S. Pat. No. 4,166,472. Alternatively, a heating element may be provided within the probes, such heating elements being well known in the art.

While this invention has been described in detail with particular reference to preferred embodiments thereof, it will be understood that variations and modifications can be made without departing from the spirit and scope of the invention as described hereinbefore and as defined in the following claims.

We claim:

1. A probe for axially twisting hair, comprising:

a pair of fingers biased together, said fingers being positioned to have facing and non-facing surfaces, said facing surfaces defining a slot for receiving and holding a group of hair to be twisted, one of said pairs of fingers being longer than the other such that said one finger extends beyond the other and defines an extension portion for guiding said hair into said slot; and means for yieldably biasing said fingers towards one another, said means being positioned so as to apply a force to said fingers intermediate the ends of said fingers, whereby said hair may be maintained in said slot by said biasing means which that said hair may be twisted about its longitudinal axis.

2. The probe of claim 1, wherein said means for yieldably biasing exerts substantially uniform pressure on a group of hair to be twisted.

3. The probe of claim 1, wherein said means for yieldably biasing comprises an elastic band encircling said fingers.

4. The probe of claim 1, further comprising a notch defined on at least one of said facing surfaces for guiding said hair into said slot.

5. The probe of claim 1, wherein said probe has a cylindrical outer surface.

6. The probe of claim 1, wherein said facing surfaces are planar.

7. A probe for axially twisting hair, comprising:

a pair of fingers biased together, said fingers being positioned to have facing and non-facing surfaces, said facing surfaces defining a slot for receiving and holding a group of hair to be twisted, one of said pair of fingers defining a shoulder against which an end of the other of said pair of fingers abuts such that said slot does not extend into said shoulder; and means for yieldably biasing said fingers towards one another, said means being positioned so as to apply a force to said fingers intermediate the ends of said fingers, whereby said hair may be maintained in said slot by said biasing means such that said hair may be twisted about its longitudinal, axis.

8. The probe of claim 7, further comprising a first annular groove defined on said non-facing surfaces, said first groove being positioned such that a portion of said first groove spans said slot intermediate said shoulder and an end of said probe facing away from said shoulder.

9. The probe of claim 8, wherein said means for yieldably biasing comprises an elasticized band positioned within said groove to exert a pressure sufficient to retain hair placed within said slot while said probe is rotated so as to axially twist said hair.

10. The probe of claim 9, further comprising a second grove defined on said non-facing surfaces, said second grove being positioned intermediate said shoulder and said first groove.

11. The probe of claim 10, further comprising a second elasticized band positioned within said second groove to exert a pressure sufficient to retain hair placed within said slot while said probe is rotated so as to axially twist said hair.

12. The apparatus of claim 8, where said means for rotating comprises an electrically driven spindle detachably connected to said probe for rotation of said probe.

13. An apparatus for axially twisting hair, comprising:

a probe, comprising:

a pair of fingers biased together, said fingers being positioned to have facing and non-facing surfaces;

an annular groove defined on said non-facing surfaces;

means for yieldably biasing said fingers towards one another disposed within said annular groove; and a slot defined by said facing surfaces for receiving and holding a group of said hair to be curled or twisted; and means for rotating said probe.

14. A method of styling hair on an individual's head into loops and folds of twisted hair, comprising:

placing an end of a group of hair in a slot defined by facing surfaces of a probe having a pair of fingers biased together;

aligning the probe with the longitudinal axis of the hair extending from said head;

rotating the probe to twist the hair axially to form loops and folds of twisted hair;

removing the hair from the probe; and securing the end of the hair to prevent the hair from untwisting.

15. The method of claim 14, further comprising the step of applying a hair holding compound to said hair.

* * * * *